United States Patent [19]

von Laar et al.

[11] Patent Number: 4,669,357

[45] Date of Patent: Jun. 2, 1987

[54] WEAPON SYSTEM WITH BARRELED WEAPON IN AN ARMORED VEHICLE

[75] Inventors: Klaus von Laar, Lauf/Pegn; Wilheim Machmer, Nurnberg; Cavit Winter, Schnaittach, all of Fed. Rep. of Germany

[73] Assignee: Diehl GmbH & Co., Nurnberg, Fed. Rep. of Germany

[21] Appl. No.: 785,876

[22] Filed: Oct. 9, 1985

[30] Foreign Application Priority Data

Nov. 6, 1984 [DE] Fed. Rep. of Germany ..... 3440467

[51] Int. Cl.[4] ..... F41F 23/06

[52] U.S. Cl. ..... 89/40.02; 89/40.03; 89/13; 89/37.07; 89/45

[58] Field of Search ..... 89/40.02, 40.03, 1.3, 89/1.35, 36.08, 37.05, 25, 37.07, 45

[56] References Cited

U.S. PATENT DOCUMENTS

| | | | |
|---|---|---|---|
| 2,788,713 | 4/1957 | Even | 89/1.815 |
| 3,818,794 | 6/1974 | Mayer et al. | 89/1.3 |
| 4,495,852 | 1/1985 | Winkler et al. | 89/46 |

FOREIGN PATENT DOCUMENTS

| | | | |
|---|---|---|---|
| 73513 | 1/1944 | Czechoslovakia | 89/25 |
| 2151878 | 4/1973 | Fed. Rep. of Germany | 89/25 |
| 2149954 | 4/1973 | Fed. Rep. of Germany | 89/40.03 |
| 2330890 | 1/1975 | Fed. Rep. of Germany . | |
| 1386910 | 3/1973 | United Kingdom | 89/36.08 |
| 2,140,537 | 11/1981 | United Kingdom | 89/40.02 |

*Primary Examiner*—Deborah L. Kyle
*Assistant Examiner*—Michael J. Carone
*Attorney, Agent, or Firm*—Scully, Scott, Murphy & Presser

[57] ABSTRACT

A weapon system incorporating a barreled weapon, which is supported in a rotatable turret dome of an armored vehicle so as to be pivotable about trunnions in the direction of elevation, which can be loaded with projectiles from the armored vehicle, and wherein the base of the barreled weapon rests at its bottom on a rail which is circular in its radius relative to the axis of the trunnions. The barreled weapon is constructed as a front-loader weapon, and possesses outside of the armored vehicle a forward barrel segment which is separate from the weapon barrel and adapted to be latched with the latter, and which is rotatable about the trunnions up to contacting end stops.

5 Claims, 2 Drawing Figures

WEAPON SYSTEM WITH BARRELED WEAPON IN AN ARMORED VEHICLE

BACKGROUND OF THE INVENTION

1. Field of the Invention

The present invention relates to a weapon system incorporating a barreled weapon, which is supported in a rotatable turret dome of an armored vehicle so as to be pivotable about trunnions in the direction of elevation, which can be loaded with projectiles from the armored vehicle, and wherein the base of the barreled weapon rests at its bottom on a rail which is circular in its radius relative to the axis of the trunnions.

2. Discussion of the Prior Art

From the disclosure of German Published Patent Application No. 23 30 890 there has become known a support for a barreled weapon in the turret of armored vehicles. The weapon barrel is restrained in a gun cradle which by means of trunnions on both sides which form the axis of elevation of the barreled weapon, is pivotably arranged in the two bearing lugs of the inner ring which is rotatable about the longitudinal bore axis of the weapon barrel.

In this known weapon system, the weapon barrel including the gun cradle, and also the ammunition magazine together form an integral structural unit. This signifies that the barreled weapon is constructed as a breech loader weapon. As a result, the weapon system including the ammunition magazine is essentially under the protection of the armor. However, it is disadvantageous in this construction of the weapon system that for the positioning of the weapon system with the ammunition magazine, there is required a relatively large amount of space within the armored vehicle. Hereby, especially the loading with longer projectile members, takes up a quite significant extent of place.

A further disadvantage which is encountered in this weapon system can be ascertained in that, during the firing of the ammunition, noxious fumes will be produced within the armored vehicle, which is not only discomforting to the operating personnel, but can also be a hazard to their health. Suitable arrangements for the rapid removal of such fumes are difficult to incorporate in the armored vehicles, and can be only implemented by means of new technology.

In the specification of German Laid-Open Patent Application No. 31 21 998 there is disclosed a weapon system which is located on an overhang in the rear end region of an armored vehicle, whereby a mortar can be lowered through a suitable opening from a traveling position into a firing position. Moreover, there is provided a loading crane which incorporates, in its upper end region, a projectile holder with a clamping device for the ammunition. In this instance, there is accordingly eliminated the problem of the noxious fumes because of the externally positioned weapon; however, at the same time there is encountered the disadvantage that, on the other hand, the mortar which is arranged outside of the armored vehicle must be always lowered from a traveling position into a firing position in order to be in a state of readiness in case of need. Furthermore, the barreled weapon which is located on the outside of the armored vehicle, cannot be adequately protected against enemy fire, which upon occasion, can lead to an adverse influence over its combat effectiveness.

SUMMARY OF THE INVENTION

Accordingly, it is an object of the present invention to create a weapon system of the above-mentioned type, in which the tube-firing or barreled weapon together with the ammunition magazine takes up only relatively little space within the armored vehicle; wherein there are additionally eliminated the problems caused by fumes, and it is also possible to provide for an automatic ammunition infeed even for differing projectile lengths.

Inventively, the foregoing object is attained in that the barreled weapon is constructed as a front-loader weapon, and outside of the armored vehicle possesses a forward barrel segment which is a separate component from the weapon barrel and is adapted to be latched with the latter, and which is rotatable about the trunnions up to the contacting of end stops.

Hereby, two diametrically oppositely located arms can be attached to the front end section of the weapon barrel, which arms extend in parallel with the axis of the bore beyond the end section of the weapon barrel, and which possess at their outer ends, in conjunction with the housing of the armored vehicle, bearing locations for the trunnions which are connected to the forward barrel segment either directly or through the intermediary of a support drum.

Pursuant to an inventive feature of the invention, there can be provided a first end stop at the front end section of the weapon barrel in such a manner that, upon contacting of the forward barrel segment with this end stop, the bore axis of the weapon barrel will be in alignment or coincide with the longitudinal axis of the barrel segment; whereas the second end stop can be arranged on the housing or body of the armored vehicle, and which retains the barrel segment in its ammunition-loading position. The longitudinal axis of the barrel segment in its ammunition-loading position extends essentially horizontal, whereby the separating plane between the barrel segment and the weapon barrel is directed towards an opening in the housing or body of the armored vehicle, behind which there are located the ammunition loading arrangement together with the ammunition magazine, whereby the longitudinal axis of the shell or projectile in the loading tray which is to be transferred is in alignment with the longitudinal axis of the barrel segment which is fixed in the ammunition-loading position. The opening in the armored vehicle which is provided for the loading of the ammunition, can be automatically closeable through the use of metal plates, louvers, hatch covers, or the like. Furthermore, an ammunition end stop can be provided at an axial distance ahead of the muzzle section of the weapon barrel in the ammunition-loading position, and which stop is fastened to the armored vehicle. Finally, the weapon barrel can project outwardly through an opening in the armored vehicle housing, which extends in the direction of elevation, and can be closeable through the intermediary of metal plates, hatch covers, or the like extending up to the weapon barrel.

By means of the foregoing, there is created a weapon system which affords the greatest possible protection by the armor, and which in addition thereto provides for a rapid firing sequence and a good utilization of space. The particular and advantageous features of the invention can be ascertained in that a simple front loader weapon can be operated under the protection of armor.

Moreover, the inventive weapon system does not possess any kind of sealing and noxious fume problems.

Furthermore, there is no requirement for a double-action trigger. In addition thereto, suitable lengths of projectiles can be utilized. Moreover, it is possible to provide for an automatic ammunition infeed at always the same input position. The weapon itself is simple and light in weight and does not necessitate the incorporation of any kind of weight balance.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
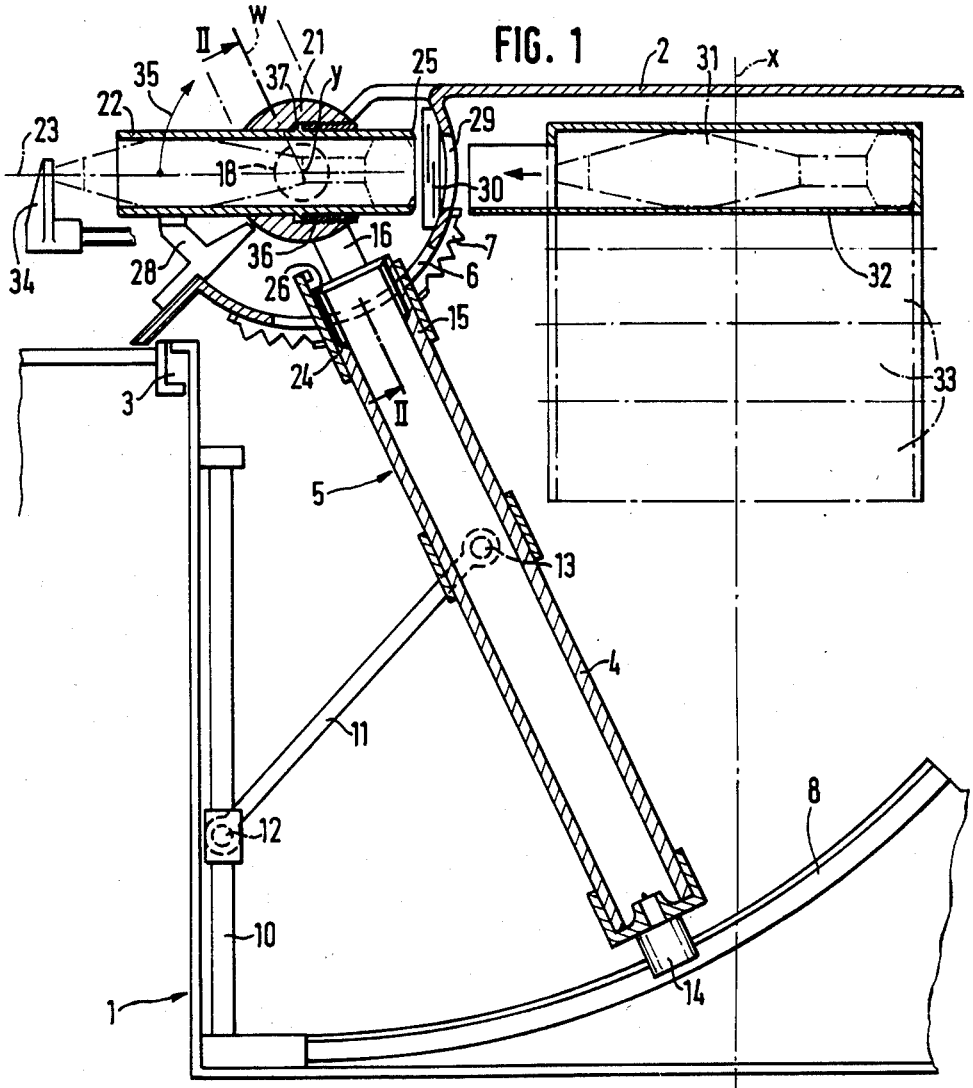
FIG. 1 illustrates a side elevational view in section through the weapon system with a front-loader weapon arranged in an armored vehicle.
Figure 2:
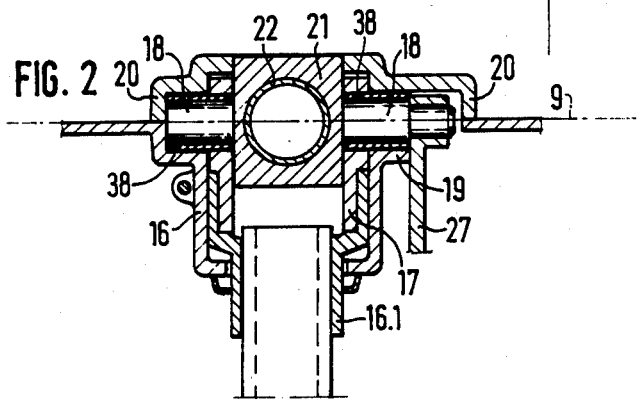
FIG. 2 illustrates, in section, the trunnion-mounted support for the forward barrel segment taken along line II—II in FIG. 1.

The armored vehicle 1 is illustrated in FIG. 1 only in part and simplified in a sectional view. The turret dome 2 is movable by means of the ring mount 3 in an azimuth direction about the axis X. The barrel 4 of the front loader weapon 5 projects through an opening 6 provided in the upper region of the turret dome 2. This opening 6 can be closed off through a metal plate or a louver 7, which is bound to the weapon barrel 4. At its bottom or base end, the front-loader weapon 5 rests on a load-supporting rail 8, which is circularly curved with its radius extending through the trunnion axis 9. This trunnion axis 9, at the same time, also forms the axis of rotation for the setting of the azimuthal angle; in effect, the angle of elevation about the Y-axis. The adjustment in height of the front-loader weapon 5 is carried out thrOugh the rotation of a threaded spindle 10 by means of drive elements (not shown). During the rotation of the threaded spindle 10, the linkage 11 moves in a knee-lever motion about the linkage points 12 and 13, while the base section 14 of the front-loader weapon 5 concurrently slides along the rail 8. Arranged at the forward end section 15 of the weapon barrel 4 are two diametrically oppositely located arms 16, which extend axially outwardly, in parallel with the bore axis W of the weapon barrel, beyond the end section 15 of the weapon barrel 4, and which project integrally from a ring-shaped base portion 16.1.

Support arms 17 are attached to the outwardly angled arms 16, and are fastened thereto by means of screws. Supported in the support arms 17 are the trunnions 18 in a bearing sleeve 38 which is fixedly supported intermediate the armor housing sections 19 and 20, so as to also concurrently support the lower and upper housing sections 19 and 20 of the armored vehicle. The axis of rotation of the trunnions 18 is concurrently the Y-axis of rotation for the setting of the vertical angle; in effect, the axis of elevation. Preferably integrally connected with the middle of the trunnions 18 is a support drum 21, which receives a forward barrel segment 22. The forward barrel segment 22 possesses the same caliber as the weapon barrel 4. The barrel segment 22 is movable about the Y-axis of rotation by means of the trunnions 18. In the firing position of the front-loader weapon 5, the longitudinal axis 23 of the barrel segment 22 is in alignment with the bore axis W of the weapon barrel 4 and contacts against an end stop 24 which is fixedly arranged on the weapon barrel 4, in such a manner, that the muzzle of the weapon barrel 4 closely fits against the upstanding end section of the barrel segment 22, which has its spherically-shaped sealing surface 25 (radius about Y) contacting against the correspondingly shaped sealing ring 26 of the weapon barrel 4. The rotational movement of the forward barrel segment 22 about the axis of elevation Y is carried out by means of a lever 27. This lever 27 can be moved manually, as well as in a motorized manner. The ammunition-loading position of the forward barrel segment 22 is attained by swinging the hand lever 27 upwardly, such that this barrel segment 22 lies in a horizontally oriented position against an end stop 28 which is fixedly interconnected with the housing of the turret dome 2. In this horizontal position, the separating plane of the barrel segment 22 points towards an opening 29 in the housing of the turret dome 2, which opening is closeable through metal plates or louvers 30. The longitudinal axis of the barrel segment 22 in its ammunition-loading position aligns with the longitudinal axis of a projectile member 31 which, for its transfer, lies on the loading tray 32 of an ammunition transfer arrangement. This loading tray 32 is in communication with an ammunition magazine through the infeed arrangement The position of the weapon barrel 4 is independent of transfer of the ammunition. The projectile 31 is inserted from the loading tray 32 through the opening 29 of the turret dome 2 and through the metal plates 30 into the horizontal ready-standing barrel segment 22.

Thereby, this projectile 31 is axially moved up to contacting an end stop 34 which is fixedly connected with the turret dome 2. Thereafter, the barrel segment 22 is rotated about the axis Y in the direction of the arrow 35, until the barrel segment lies against the end stop 24 and, in this position, is locked with the weapon barrel 4. The projectile 31 drops from the forward barrel segment 22 into the weapon barrel 4 down to the base plate, whereupon it is detonated upon impact. After the projectile 31 has exited the weapon barrel 2 and the forward barrel segment 22, this forward barrel segment 22 is again swung over into the horizontal ammunition-loading position, in order to be immediately reloaded with the new projectile. Due to this construction of the front-loader weapon, no noxious fume problems of any kind are encountered within the armored vehicle. Through a suitable length measurement of the barrel segment 22, it is possible to utilize suitable projectile lengths. The ammunition infeed in accordance with the illustrated type is especially adapted for an automatic device, inasmuch as the input position always remains the same.

The forward barrel segment 22 is retained in the support drum 21 by a threaded ring 36, which is screwed against a collet 37 on the barrel segment 22. Consequently, the support drum 21 is pivotably supported in conjunction with the barrel segment 22, without the barrel segment thereby losing its position. Moreover, the described support facilitates a simple and rapid assembly of the barrel segment 22.

What is claimed is:

1. In a weapon system with a barreled weapon which is supported in a rotatable turret dome of an armored vehicle; said barreled weapon being a frontloader weapon; support trunnions in said vehicle, said barreled weapon being rotatable about the trunnions in a direction of elevation and being loadable with projectiles from the armored vehicle and a curved rail subtending a radius relative to the trunnion axis, the base of said barreled weapon resting on said rail; the improvement comprising: a forward barrel segment separate from the weapon barrel being located externally of the armored vehicle and being latchable with said weapon barrel to provide a continuous, coaxial weapon barrel arrangement for firing a projectile, said barrel segment being rotatable about the trunnions into contact with end stops, the longitudinal axis of the barrel segment extending horizontally in the ammunition-loading position; and two diametrically oppositely located arms being arranged on the front end section of said weapon barrel, said arms extending in parallel with the bore of said barrel axially outwardly beyond the front end section of said weapon barrel, and the outer ends of said arms forming, in conjunction with the housing of the armored vehicle, support bearings for the trunnions, said trunnions being connected through a support drum with the forward barrel segment.

2. Weapon system as claimed in claim 1, wherein said end stops comprise a first end stop located at the front end section of the weapon barrel such that upon contacting of the forward barrel segment against said first end stop the bore axis of the weapon barrel is in alignment with the longitudinal axis of the barrel segment; and a second stop on the housing of the armored vehicle restrains the barreled segment in an ammunition-loading position.

3. Weapon system as claimed in claim 1, wherein one of said end stops is located at an axial distance in front of the muzzle of the forward barrel segment in the ammunition-loading position, said end stop being fastened to the armored vehicle.

4. Weapon system as claimed in claim 1, wherein the weapon barrel projects outwardly through an opening in the armored housing, said opening being closeable through closure means extending up to the weapon barrel.

5. Weapon system as claimed in claim 4, wherein the opening is automatically closeable through closure means.

* * * * *